United States Patent [19]

Kinnucan, Jr.

[11] 4,030,693

[45] June 21, 1977

[54] LONGITUDINAL JOINT ASSEMBLY IN COMBINATION WITH A PAVING FORM

[76] Inventor: Walter Frederick Kinnucan, Jr., 140 Blackstone, LaGrange, Ill. 60525

[22] Filed: Feb. 11, 1976

[21] Appl. No.: 657,086

[52] U.S. Cl. ..... 249/9; 52/396; 52/699; 404/51

[51] Int. Cl.[2] ..... E01C 19/50

[58] Field of Search ..... 249/2–7, 249/9, 208, 23, 211, 91, 177; 52/396, 699, 700, 703, 712, 714, 760; 404/47–48, 50–56, 61, 62, 68

[56] References Cited

UNITED STATES PATENTS

| | | | |
|---|---|---|---|
| 1,905,023 | 4/1933 | White | 249/9 |
| 1,948,213 | 2/1934 | Heltzel | 249/9 |
| 1,956,046 | 4/1934 | Robertson | 249/9 |
| 2,661,515 | 12/1953 | Nelsson | 52/760 |
| 2,730,784 | 1/1956 | Salisbury | 249/9 |
| 3,195,209 | 7/1965 | Klausner | 249/23 |
| 3,508,365 | 4/1970 | Ellis | 404/51 |

*Primary Examiner*—Robert L. Spicer, Jr.
*Assistant Examiner*—John McQuade
*Attorney, Agent, or Firm*—James J. Jennings, Jr.

[57] ABSTRACT

A longitudinal joint is supported adjacent the paving form by a plurality of hangers, each of which includes an attaching portion for affixing to the paving form, thus obviating the need for chair supports or other known devices for supporting a longitudinal joint. Each of these hangers includes a support-holder portion extending at an acute angle with respect to the paving form, defining an angle for receiving a portion on the longitudinal joint. This both supports the joint vertically and restrains it against horizontal movement away from the paving form. In addition the longitudinal joint is modified so that the normal apertures for receiving the extension of the tie bar, instead of being formed in a flat surface of the joint, are provided in a plane substantially perpendicular to the length or axis of the joint. The portions of the joint adjacent each bar-receiving aperture are concave and convex, in opposite directions, to allow the tie bar to be inserted behind the joint after the joint is affixed in place and supported on the road form. The tie bar can have its extremity farthest away from the joint bent at right angles to engage the ground and thus to form a support for the tie bar, doing away with the need for a bar support. Various types of hangers can be provided, for use with both metal and wooden longitudinal joints. The attaching portion can be a hook extending through an aperture in the paving form, or a longer extension which goes over and around the top of the form. With wooden forms, the attaching portion of the hanger can be a simple eye for receiving a nail to support the hanger adjacent the form.

8 Claims, 26 Drawing Figures

PAVING FORM

LONGITUDINAL JOINT FORM

TIE BAR

Joint Tie Bar

CHAIR SUPPORT

FIG. 10
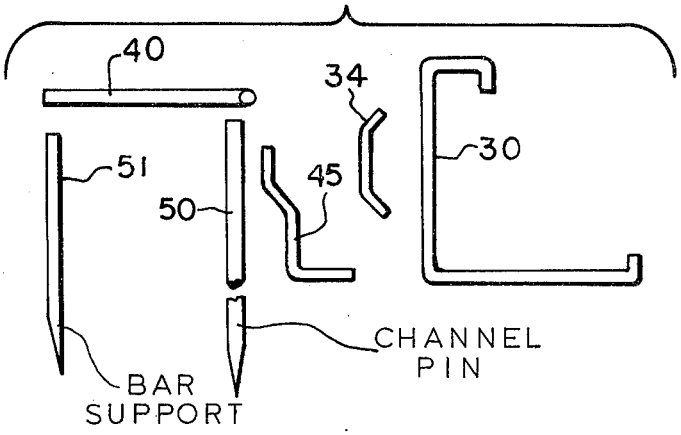
FIG. 11
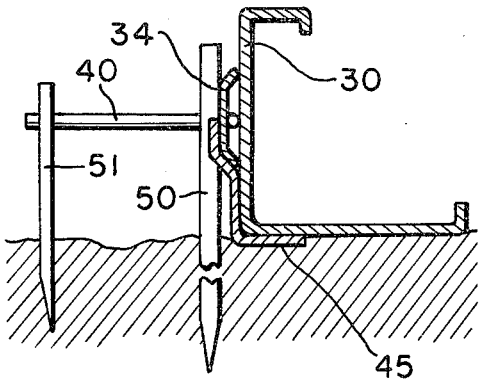
FIG. 12
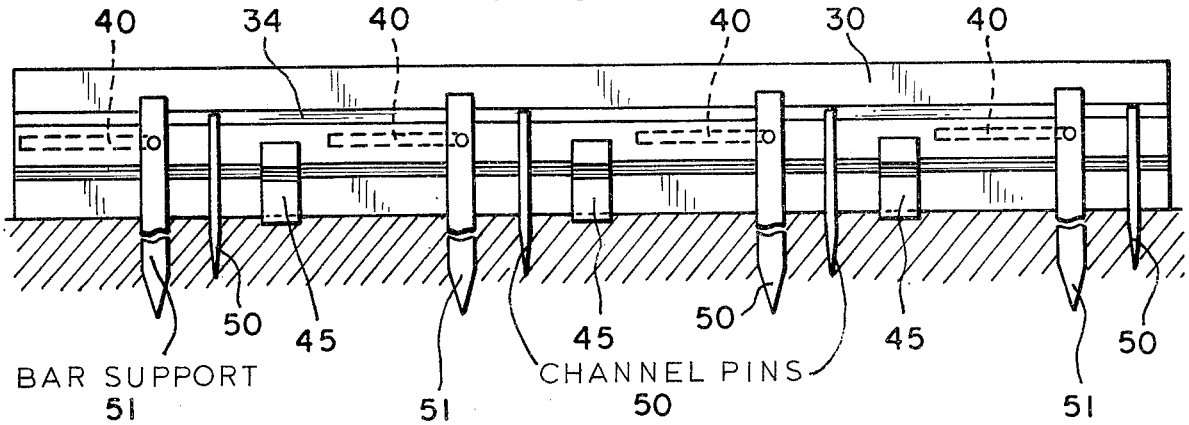
FIG. 13
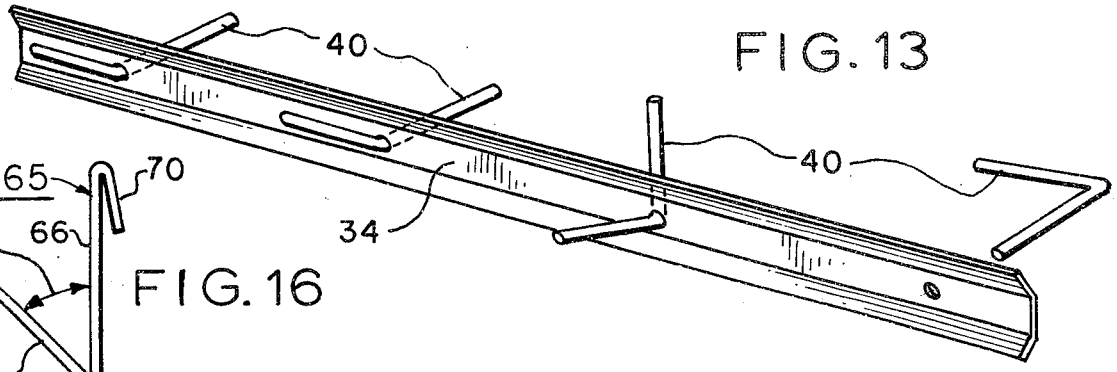
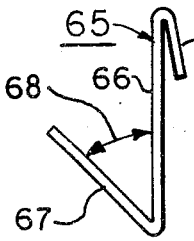
FIG. 16
FIG. 14
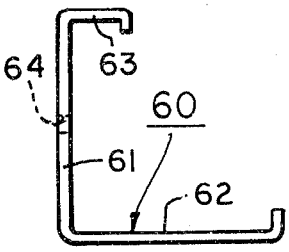
FIG. 15
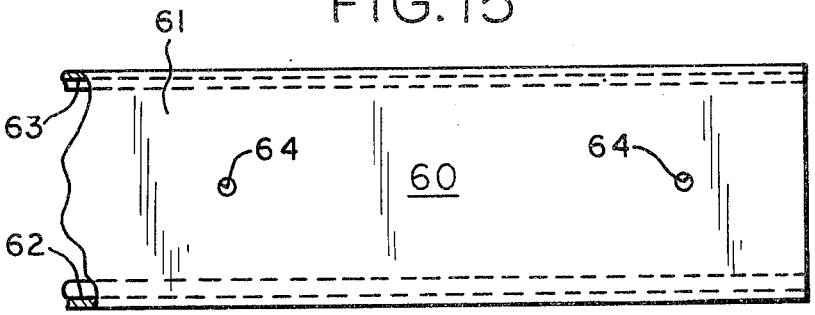

LONGITUDINAL JOINT ASSEMBLY IN COMBINATION WITH A PAVING FORM

BACKGROUND OF THE INVENTION

In construction operations where one slab is first paved, and then a second slab is paved adjacent the first slab, a longitudinal "joint" or extension is generally provided along the side of one of the slabs for mating engagement with a corresponding slot or depression in the abutting slab. In addition a plurality of "tie bars" are provided, with one end of each of these bars positioned in the first-poured slab, with the other end extending perpendicular to the slab so that, when the second slab is poured, the protruding end of the tie bar will be received in the second slab. In this way the two slabs are tied together by the bars in addition to the mating engagement between the joint and the corresponding opening in the adjacent slab.

Before the pouring operation is commenced, the paving forms are set in place to hold the poured concrete within the desired limits. Next, a plurality of "chairs" or chair support members are positioned at intervals, with a portion extending under the paving form and another portion extending upwardly to receive and support the longitudinal joint adjacent the paving form. However before the longitudinal joint can be put into position, the ends of the tie bars must be inserted through the apertures—generally four in each 10 foot length of longitudinal joint—of the joint, so that one of the right angular portions of the tie bar is positioned flush with the interior of the joint and the other extends outwardly from the joint. After the joint is in its place, it is secured by driving a plurality of channel pins into the ground alongside the longitudinal joint, so that the upper portion of each pin abuts the joint and retains it securely in place. In addition, a bar support member is then driven into the ground a short distance from the longitudinal joint. The upper end of the bar support defines an aperture for receiving the end of the tie bar, thus maintaining this portion of the tie bar extending virtually perpendicular to the paving form in a position parallel to the ground. It is thus evident that the conventional installation of a longitudinal joint assembly in conjunction with a paving form requires considerable labor, including two men to handle the joint and the four tie bars when the joint is replaced in the chair supports. In addition, a considerable amount of material is required, including the chair supports, channel pins and bar supports.

It is therefore a principal object of this invention to provide a longitudinal joint assembly for use with a paving form which substantially reduces the amount of labor required for installation.

A related object of this invention is to reduce the amount of material required to insert and support the longitudinal joint and tie bars in the proper place.

SUMMARY OF THE INVENTION

The components of the present invention are useful in conjunction with a paving form. The invention comprises a longitudinal joint and a plurality of hangers for supporting the joint. Each of the hangers includes a straight connector portion, a support-holder portion extending from one end of the connector portion and defining an acute angle relative to the form, and an attaching portion extending from the other end of the connector portion. When the paving form is of metal, apertures can be provided in the form, and the attaching portion of each hanger can then be U-shaped to extend through the form aperture and thus support the hanger. The attaching portion can also comprise an extension of the hanger to fit over the top of the paving form and thus support the hanger. If the form is of wood, the attaching portion can be a simple eye or semicircle, so that a nail or other fastener can be driven through the eye and thus support the hanger.

The longitudinal joint has a flat base portion and a pair of side walls. The joint is positioned against the form, with the joint base portion spaced from and substantially parallel to the form. One side wall of the longitudinal joint is received in the acute angle support holder portion of each hanger. This both supports the joint vertically, and in addition restrains the joint against horizontal displacement away from the form. The joint defines a plurality of concave-convex apertures, allowing a cylindrical tie bar to be inserted along the axis of the longitudinal joint, without removal of the joint from the form. With this arrangement, the end of a tie bar can readily be inserted into the aperture of the joint after the joint is positioned against the form.

In accordance with another aspect of the invention, the tie bar can be provided in a form such that no support pin is required. In the respect the extension of the tie bar outwardly from the joint is deformed to define a right angle bend, extending downwardly to engage the ground and thus support the tie bar. The invention is useable both with this self-supporting tie bar and with conventional tie bars or connecting rods.

THE DRAWINGS

In the several figures of the drawings, like reference numerals identify like components, and in those drawings:

FIG. 10 is an exploded showing, and FIGS. 11 and 12 are side and front views, depicting a known arrangement for supporting a longitudinal joint;

FIG. 13 is a perspective illustration useful in understanding the positioning problems with known longitudinal joints;

FIGS. 14 and 15 are side and front views of a paving form modified for use with the present invention;

FIG. 16 is a side view of a preferred embodiment of a hanger for use with the present invention;

Figure 17:
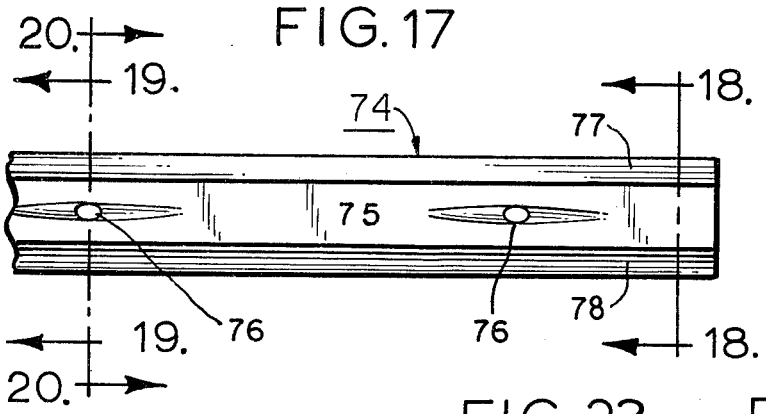
Figure 18:
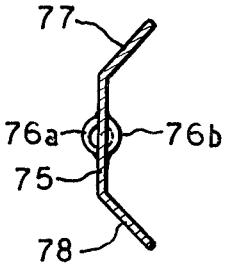
Figure 21:
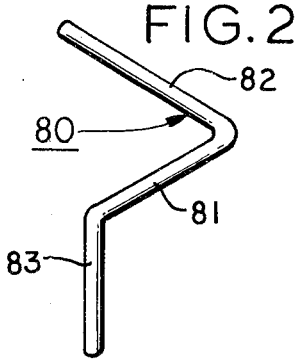
Figure 23:
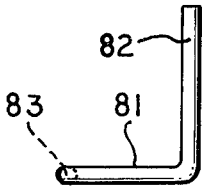
Figure 19:
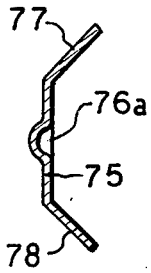
Figure 20:
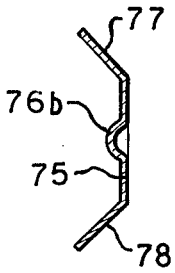
Figure 22:
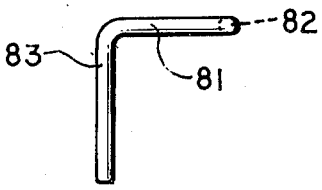
Figure 24:
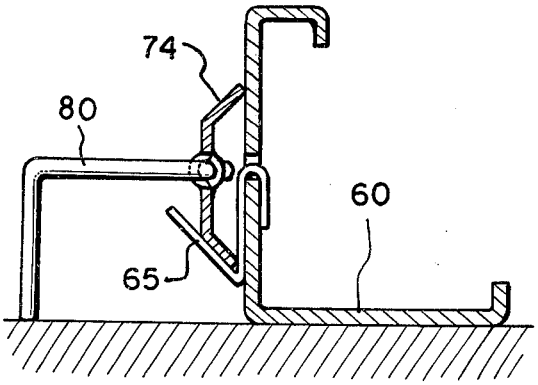
Figure 26:
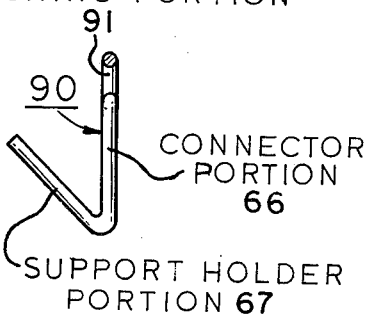
Figure 25:
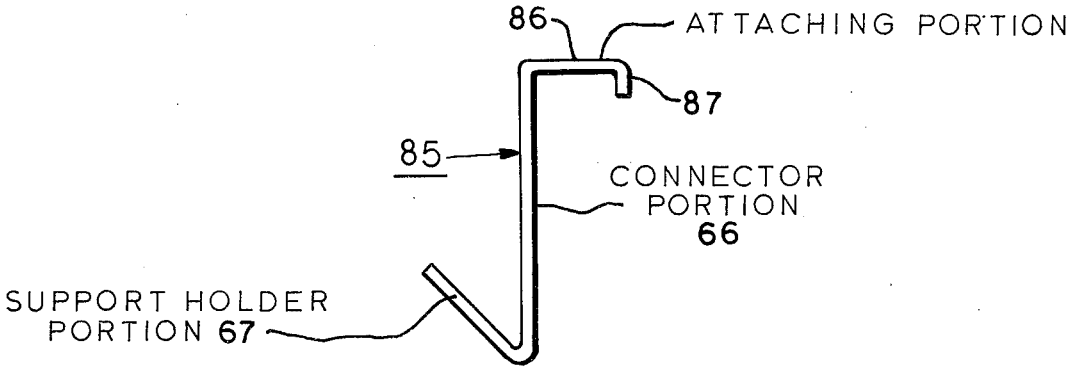

FIG. 17 is a front view, and FIGS. 18, 19, and 20 are individual sectional views taken along the lines 18—18, 19—19, and 20—20, respectively, of FIG. 17, depicting a longitudinal joint in accordance with this invention;

FIG. 21 is a perspective illustration, and FIGS. 22 and 23 are side and top views, depicting a tie bar which enhances the efficiency achieved by the present invention;

FIG. 24 is a side view showing the longitudinal joint and hanger components of this invention assembled with a paving form and a tie bar; and FIGS. 25 and 26 are side views of additional hangers suitable for use with this invention.

GENERAL BACKGROUND DESCRIPTION

Figure 1:
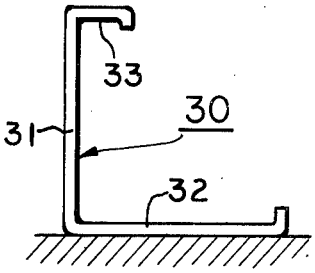
FIG. 1 is a side view of a known paving form.

Conventional paving arrangements such as those for providing a slab of concrete for use as a road section generally comprise spaced apart paving forms, such as that numbered 30 in FIG. 1. As there shown the paving or road form 30 includes a side wall portion 31 for restraining the poured concrete, a base 32 for resting on the ground or other support, and an upper leg 33. This upper leg can act as a rail for the main trucks or the guide wheels of paving equipment which is displaced longitudinally along the forms during the paving operation. If a single slab were to be poured, two spaced apart forms 30 of the type shown in FIG. 1 could be used, but if a second slab is to be laid adjacent the first, then a "longitudinal joint" is required. That is, it is desired to have a portion of the first slab extend into a correspondingly-shaped recess in the second slab, and it is further desired to have a reinforcing rod with its opposite ends embedded in each of the two adjacent slabs. To accomplish this a longitudinal joint form 34 such as shown in FIGS. 2 and 3 is generally used.

Figure 2:
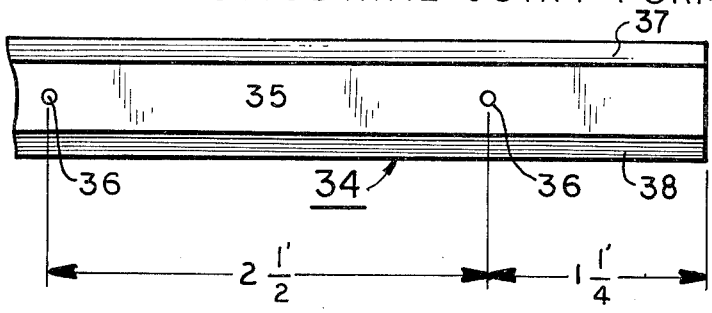
FIGS. 2 and 3 are front and side views of a longitudinal joint.
Figure 3:
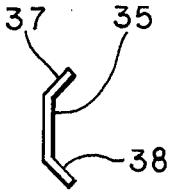
Figure 4:
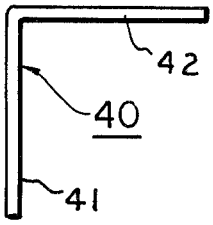
FIG. 4 is a top view of a tie bar.

In the front view of FIG. 2, the flat base portion 35 of the joint is shown, defining spaced-apart apertures 36. These apertures are generally about ⅞ inch in diameter, for receiving a reinforcing rod of ½ or ⅝ inch diameter thickness. A pair of side walls 37, 38 extend from the base portion 35 of the longitudinal joint at an angle as illustrated in the side view of FIG. 3. Thus it is apparent that if the longitudinal joint as shown in FIG. 3 can be positioned adjacent the center side wall 31 of the paving form, and maintained in this position, a tie bar can be extendwd through each of the apertures 36 for subsequent mating with the next-poured slab. In addition the longitudinal joint will provide a recess or keyway in the side of the first-poured slab to receive an extension of the second slab and thus afford a good junction between adjacent slabs. The paving form as seen in the side view of FIG. 1 is generally 10 inches high when a 10 inch course of pavement is to be laid, and the base leg 32 would also be 10 inches, with the upper leg 33 about 2 inches. Each longitudinal joint 34 is normally about 10 feet in length, with the apertures 36 spaced apart by 2½ feet, and 1⅔ feet from each end of the joint. Each tie bar 40, as shown in FIG. 4, is generally a right-angle unit comprised of two legs 41 and 42. The tie bar can be ½ or ⅝ inch diameter steel, depending upon the thickness of the courses to be joined with the tie bar.

Figure 5:
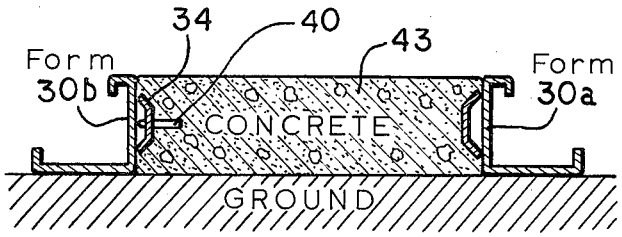
FIGS. 5 and 6 are sectional illustrations useful in understanding the pouring of multiple concrete slabs in conventional manner.
Figure 6:
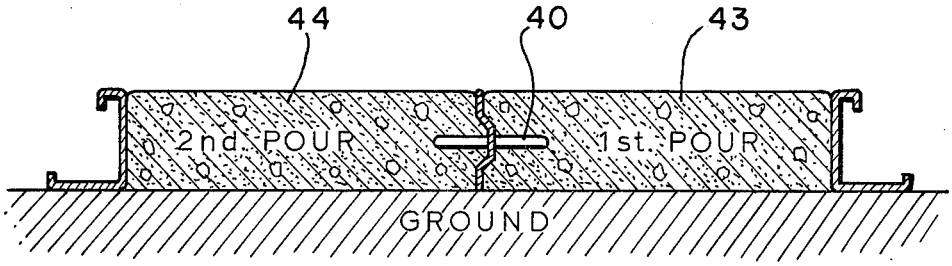

FIG. 5 depicts in a general way the manner in which two paving forms **30*a*, 30*b* are used to pour a first slab of concrete 43 between the forms. It is assumed that no additional concrete is to be poured to the right of form 30*a*, but an additional slab is to be laid to the left of paving form 30*b*. Accordingly a longitudinal joint 34 with a tie bar 40 inserted as shown in provided before the first slab 43 is poured. After the concrete has set up or cured, form 30*b* is removed and the tie bar 40 extremity is pulled outwardly to extend to the left, as shown in FIG. 6. The form 30*b* is then moved to the left to the proper position, and the second slab 44 is poured, abutting the first slab 43. In this way a portion of the second slab 44 extends into the indentation provided by the joint 34, and the tie bar 40** provides a structural tie between the two slabs.

Figure 7:
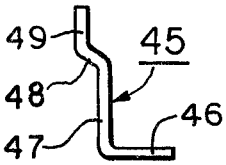
FIG. 7 is a side view of a chair support for a longitudinal joint.
Figure 8:
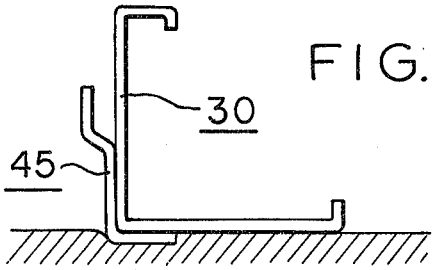
FIGS. 8 and 9 are side and front views depicting the placement of chair supports against the longitudinal joint.
Figure 9:
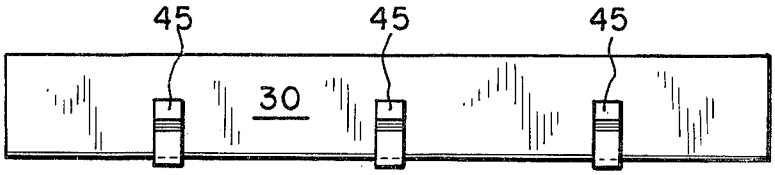

It is apparent that some means must be provided to support the longitudinal joint 34 in a position near the center of the wall portion of the form 30. FIG. 7 depicts in side view a chair support 45, or simply a chair, having a base portion 46 for placement between the base leg 32 of the paving form on the ground, and a side wall portion 47 for abutting the side wall 31 of the paving form. The upper end of side wall portion 47 is bent to form a connecting portion 48, and then the remainder is bent back in a portion 49 substantially parallel to the side wall portion 47. The portions 48, 49 together form a means for receiving and supporting the lower side wall 38 and the bottom part of the base 35 of a longitudinal joint 34, when the chair is placed in its proper position adjacent the paving form as shown in FIG. 8. For each 10 foot section of paving form 30, as shown in FIG. 9, three separate chairs 45 can be used and spaced apart at 2½ foot intervals, with another 2½ ft. interval between the end of the form and the outer chair supports 45. There are two additional components necessary to support the longitudinal joint and the tie bars, and they are shown in the exploded view of FIG. 10.

The components depicted spaced apart in FIG. 10 are also shown in their assembled relation in FIG. 11. To maintain the longitudinal joint 34 in its position after it has been dropped into the space provided by the chair supports 45, a plurality of channel pins 50 driven into the ground adjacent the form-and-joint assembly. The channel pins are generally of 16 gauge steel, and long enough to securely hold the longitudinal joint in place as shown in FIG. 11. As noted previously the tie bars are placed into position so that a portion of them is within the interior of the longitudindal joint when it is dropped into position in the chair support. A plurality of bar supports 51 are provided and driven into the ground as shown to receive and support the end of the tie bar 40 in a position substantially parallel the ground and virtually perpendicular to the side wall of the paving form. This provides the necessary orientation of the tie bar so that the second-poured slab will incorporate this end of the tie bar and thus provide the tied joint between the two adjacent slabs or courses. The complete assembly when viewed from the front is shown in FIG. 12. It is again noted that two men are required to drop the joint 34 and tie bars 40 into place. FIG. 13 shows a single joint and four tie bars. One man is required to hold the two tie bars at the left end, and support the left end of the joint, while the second man grasps the other two tie bars and supports the right end of the longitudinal joint. Thus the considerable amount of labor and the expense entailed in the various support materials is apparent from the foregoing description.

Detailed Description of the Invention

It will become evident from the subsequent explanation that this invention can be practiced both with conventional paving forms such as that already depicted and a paving form slightly modified, as shown in the side view of paving form 60 in FIG. 14. That unit has a side wall 61, a base portion 62 and an upper leg 63 generally corresponding to the analogous portions in FIG. 1, except that the side wall portion 61 defines an aperture 64. In reality there are four spaced-apart apertures 64 in each 10 foot section of the form, a portion of which form is shown in FIG. 15. The individual apertures 64 provide entrances for a portion of each hanger 65, shown in FIG. 16.

Hanger 65 includes a straight connector portion 66 as a central member. A support-holder portion 67 extends from one end of the connector portion 66 to define an angle 68 as shown. This angle 68 represents an acute angle defined by the supportholder portion 67 and the connector 66, or between portion 67 and the side wall 61 of the paving form. By making this angle the appropriate one to receive the lower side wall of the longitudinal joint, it is apparent that the joint can readily be supported when several such hangers are affixed to the form. The hanger 65 further comprises an attaching portion 70 extending from the other end of the connector portion 66. In this embodiment there is a generally U-shaped bend between the connector portion 66 and the attaching portion 70, and the leg or attaching portion 70 extends substantially parallel with the connector portion 66. Thus the attaching portion 70 in effect defines a hook for extension through one of the apertures 64 in the paving form to support the entire connector 65 in the desired position to receive and support the longitudinal joint.

In accordance with another aspect of the invention, a longitudinal joint 74 is provided as shown in the front view of FIG. 17. The joint 74 has a base portion 75 and apair of side walls 77, 78 generally similar to the base and side walls of the conventional joint depicted in FIGS. 2 and 3. However the apertures 76 defined by the base portion 75 in FIG. 17 are not mere openings in the plane of the base portion, but are concave-convex apertures for receiving the extension of a tie bar substantially parallel to the base and the form. That is, as shown in the sectional view of FIG. 18, base portion 75 is substantially flat at a point intermediate the apertures 76. However looking through the plane of the left aperture 76, in the direction represented by the arrows 19—19, FIG. 19 shows that one half of aperture 76 is defined by the semicircle 76*a*, and the other side of this aperture, looking in the direction 20—20, is completed by the portion 76*b* as shown in FIG. 20. As before, the lower side wall 78 forms an acute angle with the form when placed adjacent the form to fit within the angle 68 defined by the hanger 65. This allows for insertion of the tie bars one at a time, after, not before, the longitudinal joint has been slipped into position to be supported by the plurality of hangers 65. Thus this step can be accomplished by one man, as opposed to two men required in the conventional system to hold the usual right-angle tie bars in place behind the longitudinal joint 34 as it is dropped behind the support chairs.

It will become apparent that the inventive assembly such as hangers 65 and the unobvious longitudinal joint 74 can be used in conjunction with conventional tie bars such as that shown in FIG. 4. When so used, one end portion 42 can be inserted through each of the apertures 76 and the other end portion is left extending outwardly from the longitudinal joint, and can be supported by a bar support 51 as known in this art. This is especially useful in the transition phase to complete use of the present invention, where there is an inventory of conventional tie bars on hand and it is desired for economic reasons to use the available tie bars. However in accordance with another aspect of the invention, it is possible to use a tie bar such as the bar 80 depicted in FIG. 21 and eliminate the need for bar supports.

Tie bar 70 depicted in FIG. 21 has a straight center portion 81, and a first end portion 82 extending at right angles to the center portion 81. This end portion 82 can be inserted through one of the concave-convex apertures 76 in longitudinal joint 74, to rest between the joint and the paving form. In accordance with this invention, tie bar 80 has a second end portion 83 extending at right angles both with respect to center portion 81 and the other end portion 82. Portion 83 is dimensioned to touch the ground and support the tie bar center portion substantially parallel to the ground and perpendicular to the paving form. Generally conventional tie bars are about 30 inches in length, with each of the legs (such as 41, 42 in FIG. 4) 15 inches in length. In the configuration of the new tie bar 80 shown in FIG. 21, the center portion 81 is approximately 10 inches in length, first end portion 82 about 15 inches in length, and the second end portion 83 which abuts the ground about 5 inches in length. FIGS. 22 and 23 are provided as side and top views to better illustrate the three mutually perpendicular portions of the novel tie bar 80 for use in the system of this invention. When assembled the illustration of FIG. 24 shows the manner in which the hangers 65 retain the longitudinal joint 74 in position abutting the form 60, and each of the tie bars 80 can be simply inserted into the aperture so that no additional bar supports are required.

Previously it was noted that various types of hangers can be provided, and that it is not necessary to modify conventional paving forms such as that depicted in FIG. 1. FIG. 25 shows another connector 85, which also has a connector portion 66 and a support-holder portion 67 similar to that of the first hanger 65. However the attaching portion of hanger 85 includes a first leg 86 extending at a right angle from the straight connector portion 66, and a second leg 87, shorter than leg 86 and extending at a right angle to that first leg 86, substantially parallel to the connector portion 66. Thus the combined attaching portion 86, 87 with the center connector portion 66 defines an inverted U-shaped for fitting over the top rail portion 33 of a conventional paving form as depicted in FIG. 1. Such hangers would of course have the attaching portion 86, 87 of substantially flat wire to allow for easy passage of wheels or other portions of paving equipment over the top of the form.

It sometimes happens that the paving forms are comprised of wood rather than metal. To this end another hanger embodiment 90 is shown in FIG. 26. As before the central connector portion 66 and the support-holder 67 are virtually the same. However the attaching portion of hanger 90 shown in FIG. 26 includes an eye 91 for receiving a nail or other fastener driven through the eye and into the adjacent wood of the paving form. Of course the eye need not be completely closed, but a generally semi-circular hanger portion can be provided to support the hanger 90 on whatever projection is available on the wooden form.

Technical Advantages

It is immediately apparent that use of any of the hanger arrangements 65, 85 and 90 in conjunction with the longitudinal joint 74 provides significant advantages in the reduction in labor. Only one man is required to position the hangers and drop the longitudinal joint into place. In addition to this substantial reduction of labor, parts such as the chair supports 45 and channel pins 50 are eliminated, even with the use of conventional tie bars. Use of the unobvious tie bar 80 depicted in FIGS. 21–23 further reduces the material by eliminating the need for any bar supports.

What is very important to the very successful operation of the invention, and completely unexpected, is that the hangers not only retain the longitudinal joint vertically against the form, but afford a substantial restraint against unwanted displacement of the joint horizontally, away from the paving form. In that the support-holder portion 67 of each hanger merely extends at an acute angle, and does not bend upwardly and around the base portion 75 of the longitudinal joint, it is not readily apparent that a substantial component of horizontal restraint would be provided by the hangers. However it has been found the longitudinal joints are secured with significant restraint both against a vertically downward displacement and against horizontal displacement away from the paving form.

While only particular embodiments of the invention have been described and illustrated, it is apparent that various modifications and alterations may be made therein. It is therefore the intention in the appended claims to cover all such modifications and alterations as may fall within the true spirit and scope of the invention.

I claim:

1. The combination of a paving form and:

a plurality of hangers, each having a straight connector portion, a support-holder portion extending from one end of the connector portion, and an attaching portion extending from the other end of the connector portion attaching each hanger to the form so that the support-holder portion extends at an acute angle relative to the connector portion:

a longitudinal joint, having a base portion and a pair of side walls, the longitudinal joint being positioned against the form with the base portion spaced from and substantially parallel to the form, one side wall of the longitudinal joint being received in the acute angle defined by each hanger connector and support-holder portions, both to support the joint vertically and restrain the joint from horizontal displacement away from the form, which joint also defines a plurality of concave-convex apertures for receiving a cylindrical tie bar along the axis of the longitudinal joint; and a plurality of tie bars, each having a first end portion and a second end portion extending at right angles to the first end portion, with the second end portion inserted through one of the concave-convex apertures of the joint into the space between the form and the joint.

2. The combination of claim 1, in which the attaching portion of each hanger includes a U-shaped bend and a leg extending substantially parallel to the connector portion, to define a hook which extends through an aperture in the paving form.

3. The combination of claim 1, in which the attaching portion of each hanger has a first leg extending at a right angle from the straight connector portion, and a second leg extending at a right angle from the first leg and substantially parallel to the straight connector portion, defining with the connector portion an inverted U-shape which fits over the top of the paving form.

4. The combination of claim 1, in which the attaching portion of each hanger defines a substantially circular eye, which receives a nail or similar fastener driven through the eye into the paving form to support the hanger adjacent the form.

5. The combination of a paving form and:

a plurality of hangers, each having a straight connector portion for abutting the form, a support-holder portion extending from one end of the connector portion, and an attaching portion affixed to the other end of the connector portion attaching each hanger to the form, with the support-holder portion defining an acute angle with the connector portion;

a longitudinal joint, having a generally flat base portion and a pair of side walls, each side wall extending at an acute angle, measured with respect to an extension of the base portion, which is substantially equal to the acute angle defined between the hanger connector portion and support-holder portion, the longitudinal joint being positioned against the form with the base portion spaced from the substantially parallel to the form, one side wall of the joint being received between each hanger connector portion and each hanger support portion, both to support the joint vertically and restrain the joint from horizontal displacement away from the form, which joint also defines a plurality of concave-convex apertures for receiving a cylindrical tie bar along the axis of the longitudinal joint; and a plurality of the tie bars, each having a straight center portion, a first end portion extending at right angles to the center portion and inserted through one of the concave-convex apertures into the space between the form and the joint, and a second end portion, extending at right angles with respect to both the center portion and the first end portion, to touch the ground and support the tie bar center portion substantially parallel to the ground.

6. The combination of claim 5, in which the attaching portion of each hanger includes a U-shaped bend and a leg extending substantially parallel to the connector portion, to define a hook which extends through an aperture in the paving form.

7. The combination of claim 5, in which the attaching portion of each hanger has a first leg extending at a right angle from the straight connector portion, and a second leg extending at a right angle from the first leg and substantially parallel to the straight connector portion defining with the connector portion an inverted U-shape which fits over the top of the paving form.

8. The combination of claim 5, in which the attaching portion of each hanger defines a substantially circular eye, which receives a nail or similar fastener driven through the eye into the paving form to support the hanger adjacent the form.

* * * * *